US005240238A

United States Patent [19]

Lee

[11] Patent Number: 5,240,238

[45] Date of Patent: Aug. 31, 1993

[54] CASSETTE USED FOR ELECTROPHOTOGRAPHIC PROCESS ENGINE

[75] Inventor: Han-Gyo Lee, Seoul, Rep. of Korea

[73] Assignee: SamSung Electronics Co., Ltd., Kyungki, Rep. of Korea

[21] Appl. No.: 812,944

[22] Filed: Dec. 24, 1991

[30] Foreign Application Priority Data

Oct. 25, 1991 [KR] Rep. of Korea ..... 1991-18824

[51] Int. Cl.[5] ..... B65H 3/44

[52] U.S. Cl. ..... 271/9; 271/145

[58] Field of Search ..... 271/9, 145, 157, 164

[56] References Cited

U.S. PATENT DOCUMENTS

| | | | |
|---|---|---|---|
| 4,966,356 | 10/1990 | Ohyabu et al. | 271/9 |
| 5,002,266 | 3/1991 | Kikuchi et al. | 271/9 |
| 5,052,670 | 10/1991 | Makiura et al. | 271/164 |
| 5,085.422 | 2/1992 | Sagara | 271/145 |
| 5,132,742 | 7/1992 | Goto | 271/9 |

FOREIGN PATENT DOCUMENTS

| | | | |
|---|---|---|---|
| 370484 | 5/1990 | European Pat. Off. | 271/9 |
| 53944 | 3/1989 | Japan | 271/9 |
| 123042 | 5/1990 | Japan | 271/9 |
| 178121 | 7/1990 | Japan | 271/9 |

*Primary Examiner*—Robert P. Olszewski
*Assistant Examiner*—Steven M. Reiss
*Attorney, Agent, or Firm*—Robert E. Bushnell

[57] ABSTRACT

An optional cassette can be used for a electrophotographic process engine which occupies a minimum installation space and provides easy removal of jammed paper. A lower surface of the electrophotographic process engine is joined in steps with an upper surface of the optional cassette, and the the electrophotographic process engine comprises a second paper cassette and a second transmission passage formed vertically to a pull of paper in the second paper cassette. The optional cassette comprises an optional cassette module having a paper cassette slot for inserting a first paper cassette, and a pick up roller for picking up a paper form an uppermost paper of a paper pile in a position near the paper cassette slot and in the upper side of the option cassette module. A transmission unit, installed rotatably to the optional cassette with hinges under the second paper cassette 15, has a first transmission passage formed vertically to a pull of the first paper cassette and is connected with a second transmission passage.

6 Claims, 3 Drawing Sheets

CASSETTE USED FOR ELECTROPHOTOGRAPHIC PROCESS ENGINE

BACKGROUND OF THE INVENTION

The present invention relates to an optional cassette used for an electrophotographic process engine, and more particularly to a device for minimizing an installation space of the optional cassette by simplifying a configuration of the optional cassette, and for removing a jammed paper easily.

With reference to FIG. 1, a conventional optional cassette 1 comprises an optional cassette module 3 having a paper cassette 4. A pick up roller 6, installed in an upper side of the optional cassette module 3, picks up a paper 5 on the paper cassette 4. A transmission unit 8 can be rotated about a hinge 7 located over the paper cassette slot 2. The transmission unit 8 comprises a transmission passage 9 for passing the paper 5 supplied by the pick up roller 6. An upper end of the paper passage 9 is bent to communicate with a paper supplying passage 12 of an electrophotographic process engine 11. A transmission roller 10 is installed in the transmission passage 9 for transmitting the paper 5 to the paper supplying passage 12.

A shown in FIG. 1, the electrophotographic process engine 11 is installed on an upper side of the optional cassette 1, which can be used selectively if necessary, so that the paper supplying passage 12 of the electrophotographic process engine 11 is interfaced with the transmission passage 9 formed in the transmission unit 8.

The paper cassette 4 loaded with the paper 5 is installed in the optional cassette module 3 through the paper cassette slot 2 of the optional cassette 1. The pick up roller 6 picks up the paper 5 on an uppermost of many sheets of paper stacked in the paper cassette 4. The paper 5 is induced to one end of the transmission unit 8 through the transmission passage 9, the other end of the transmission unit 8 faces the paper supplying passage 12 of the electrophotographic process engine 11. The induced paper 5 is transmitted to a supplying roller 13 of the electrophotographic process engine 11 by the transmission roller 10 positioned in the transmission passage 9. The supplying roller 13 then supplies the paper 5 to a photosensitive device 14.

Accordingly, the present invention allows installation of the electrophotographic process engine on an improved optional cassette that requires less space since the transmission unit 8 of the improved optional cassette does not extend beyond the electrophotographic process engine 11, in contrast to the conventional transmission unit which is positioned on an outside of the electrophotographic process engine 11. The present invention also limits paper jams by shortening paper passages. Furthermore, the conventional optional cassette encounters a problem of the paper cassette pulling out when the transmission unit 8 is rotated about hinge 7.

SUMMARY OF THE INVENTION

An object of the present invention is to provide an optional cassette which occupies a minimum installation space for use with an electrophotographic process engine.

Another object of the present invention is to provide an optional cassette for use with an electrophotographic process engine in which a jammed paper is easily removed.

Still another object of the present invention is to provide a conveniently used optional cassette for use with an electrophotographic process engine.

According to the present invention, an optional cassette is provided for use with an electrophotographic process engine with a lower surface joined by an upper surface of the optional cassette. The electrophotographic process engine has a second paper cassette and a second transmission passage formed vertically to a pull of paper in the second paper cassette. The optional cassette comprises an optional cassette module having a paper cassette slot for inserting a first paper cassette, and a pick up roller for picking up a paper in a position near the paper cassette slot and on the upper side of the optional cassette module. A transmission unit, installed rotatably at a hinge and under the second paper cassette, has a first paper cassette for connection with a second transmission passage. Also the transmission unit has a transmission roller installed in the first transmission passage, for transmitting the picked-up paper to the second transmission passage of the electrophotographic process engine.

BRIEF DESCRIPTION OF THE DRAWINGS

For a better understanding of the invention, and to show how the same may be carried into effect, reference will now be made by way of example to the accompanying diagrammatic drawings in which.

DETAILED DESCRIPTION OF THE PREFERRED EMBODIMENT

An electrophotographic process engine 11 is installed on a top surface of an optional cassette 1 which is available for selective use. The electrophotographic process engine 11 and the optional cassette 1 are joined together.

Figure 1:
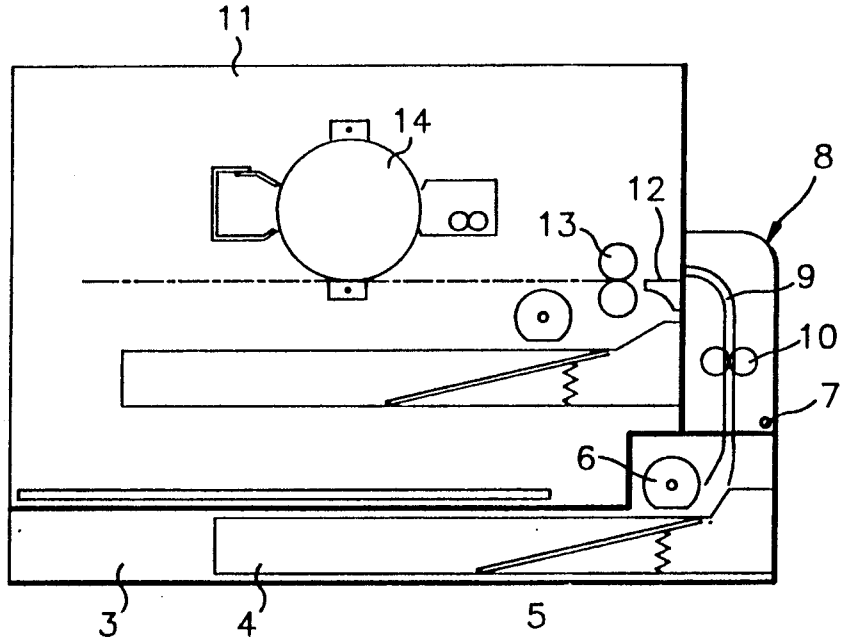
(PRIOR ART) FIG. 1
FIG. 1 is a cross sectional view of a conventional electrophotographic process engine with a conventional optional cassette.
Figure 2:
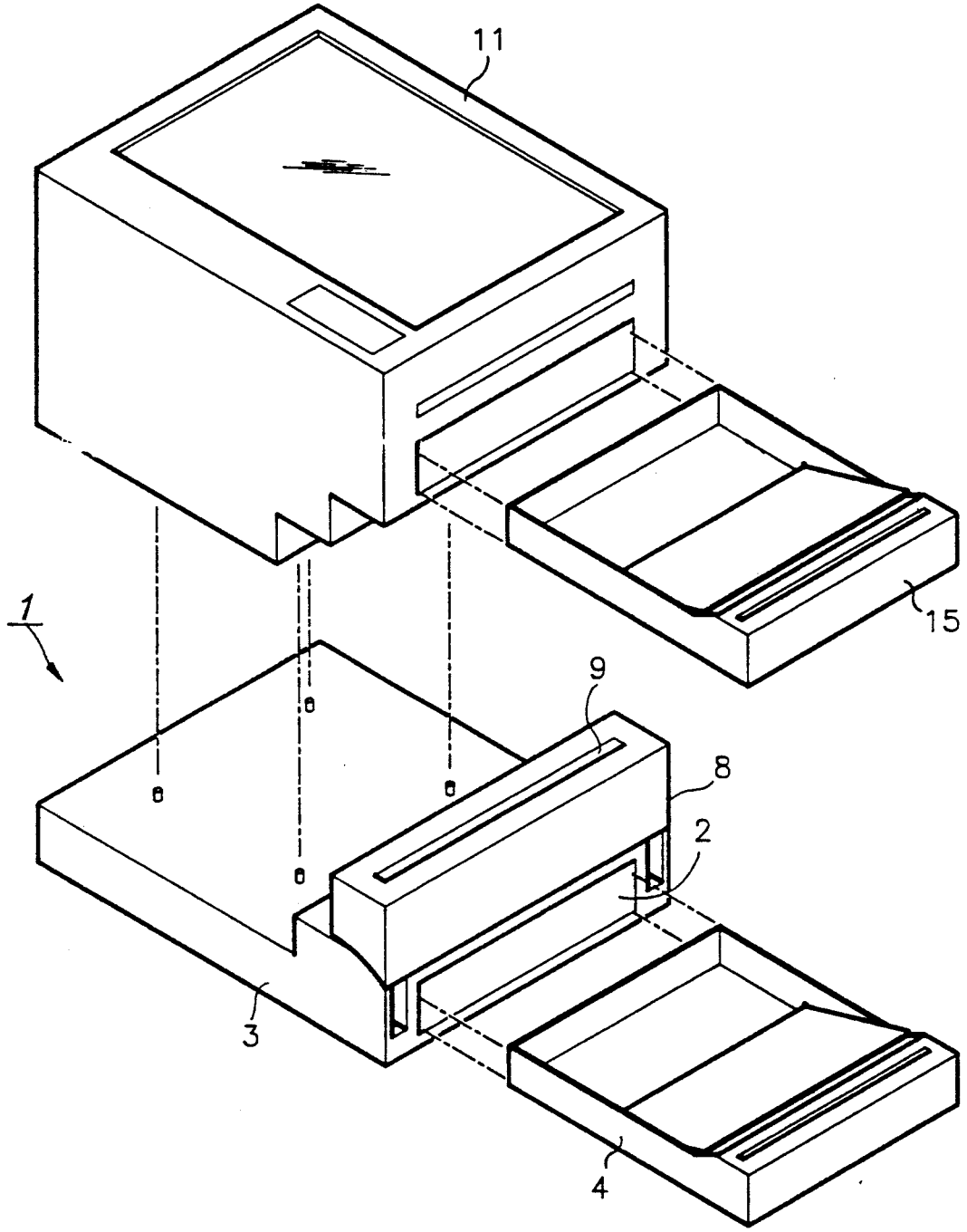
FIG. 2 is a perspective view of an electrophotographic process engine with an improved optional cassette, according to a preferred embodiment of the present invention.
Figure 3A:
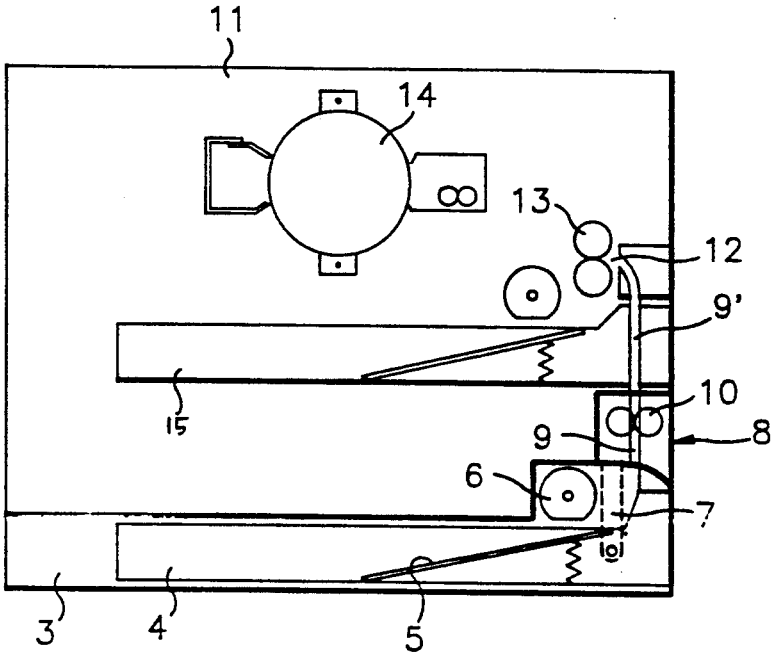
FIGS. 3A and 3B are cross-sectional views of an electrophotographic process engine with an improved optional cassette according to the preferred embodiment of the present invention.
Figure 3B:
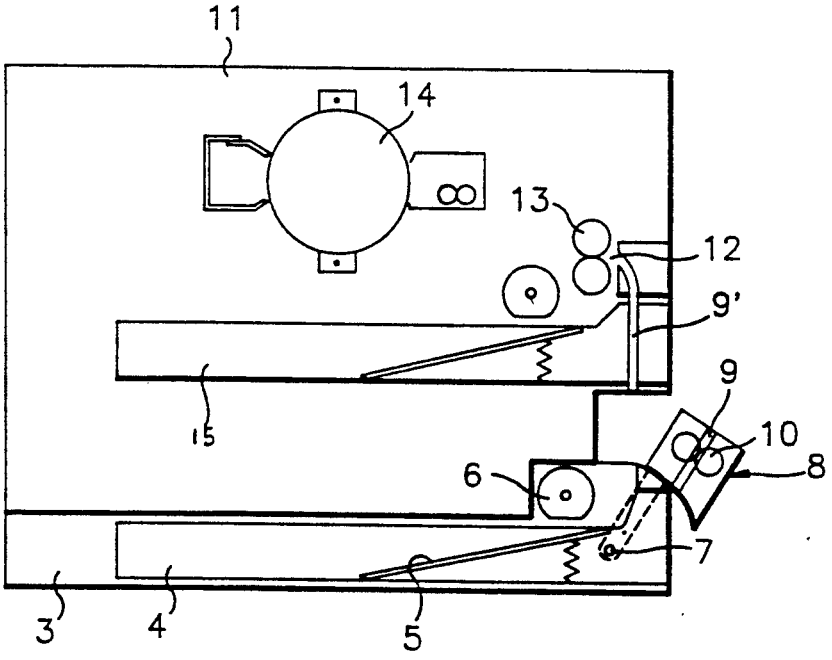

A lower portion of the electrophotographic process engine 11 accommodates a second paper cassette 15 which has a second transmission passage 9' as shown in FIG. 3A.

The optional cassette 1 has an optional cassette module 3 with a paper cassette slot 2 for inserting a first paper cassette 4, and a pick up roller 6 for supplying a paper 5 installed on an internal upper side of the optional cassette module 3 near the paper cassette slot 2.

A first transmission passage 9 is formed in the transmission unit 8 under the second paper cassette 15 and interfaced with the second transmission passage 9'. A transmission roller 10 is located within first transmission 9. A transmission unit 8 including the first transmission passage 9 and the transmission roller 10 is connected to hinges 7 adjacent to the pick up roller 6 and an upper side of the paper cassette slot 2 and under the second paper cassette 15, to be rotatable and assembled with the electrophotographic process engine as an unit.

An operation of the above mentioned parts and components will be described as follows.

The lower surface of the electrophotographic process engine 11 is interconnected in a steplike manner with the upper surface of optional cassette 1 including transmission unit 8. The second cassette 15 of the electrophotographic process engine 11 is positioned above the transmission unit 8, so that the first transmission passage 9 is formed vertically to a pull-out direction of the second paper cassette 15.

The paper 5 of first paper cassette 4 is selected by a selection button (not shown in the drawing) of the electrophotographic process engine 11, and the pick up roller 6 transmits paper 5 as an uppermost piled paper in the paper cassette 4 to the first transmission passage 9 by a function button (not shown in drawing) of the electrophotographic process engine 11. The paper 5 is then transmitted to a third paper transmission passage 12 of the electrophotographic process engine 11 by way of the second transmission passage 9' by the transmission roller 10. Finally the paper 5 is transmitted to a photosensitive device 14 by a supplying roller 13 in the electrophotographic process engine 11.

When a paper is jammed the transmission unit 8 can be rotated around hinges 7 so that a top surface of the transmission unit 8 is detached from a bottom surface of the second paper cassette 15, thus exposing outwardly the transmission passage 9 of the transmission unit 8 which faces the transmission passage 9' of the electrophotographic process engine 11. Accordingly, it is easy to take out the jammed paper from the upperside of the transmission unit 8 when paper jams in the optional cassette 1 and in the second and third transmission passages 9' and 12, after pulling out the second paper cassette 15 from the electrophotographic process engine 11.

After removing the jammed paper from the transmission passage 9, 9' or 12, the transmission unit 8 is reinstalled by rotation about hinges 7 and the second paper cassette 15 is inserted. The hinges 7 are formed on two opposite inner side walls of the optional cassette module 3.

In conclusion, the optional cassette 1 is able to be assembled with the electrophotographic process engine 11 as a unit to minimize installation, allow easy removal of jammed paper and allow ease in use.

While the invention has been particularly shown and described with reference to one preferred embodiment, it will be apparent to those who are skilled in the art that changes in form and detail may be made without departing from the spirit and scope of the invention.

What is claimed is:

1. An optional cassette apparatus used in an electrophotographic process engine, comprising:

a first cassette installed in said electrophotographic process engine;

a first transmission passage formed perpendicular to a plane of a paper of said first paper cassette in said electrophotographic process engine;

a second paper cassette;

an optional cassette module installed in a lower part of an optional cassette, said optional cassette comprising a paper cassette slot for accommodating insertion of said second paper cassette;

a pick up roller positioned at a predetermined distance from said paper cassette slot and in an upper part of said optional cassette module, for picking up an uppermost paper of a plurality of papers loaded in said second paper cassette;

a transmission unit connected pivotally to the optional cassette module by a hinge located below said first paper cassette, said transmission unit comprising a second transmission passage formed perpendicular to a plane of said plurality of papers of said second paper cassette, said hinge being formed on an inner side wall of said optional cassette module; and a transmission roller installed in said second transmission passage, for transmitting the picked-up paper to said electrophotographic process engine, wherein a lower surface of said electrophotographic process engine joins an upper surface of said optional cassette module so that said second transmission passage faces and is aligned with said first transmission passage.

2. The optional cassette apparatus of claim 1, wherein the second paper cassette comprises an enclosed and integral third transmission passage aligned between said first transmission passage and said second transmission passage while said second paper cassette is inserted within said paper cassette slot.

3. An optional cassette apparatus, comprising:

an electrophotographic process engine having a housing formed with oppositely disposed side walls enclosing said process engine, said process engine comprising first transmission means providing a first transmission passage, for transmitting sheets of paper from said first transmission means to said process engine; and an optional cassette module, positioned beneath said housing with all side surfaces of said optional cassette module being substantially flush with corresponding ones of said side walls, and connected to the electrophotographic process engine in a predetermined installation space, said optional cassette module comprising a paper cassette slot for receiving a first paper cassette retaining a plurality of sheets of paper lying within a stack with an outermost one of the sheets of paper forming a plane substantially perpendicular to said first transmission passage, said optional cassette module receiving the first paper cassette wholly within said optional cassette module, and comprising a transmission unit, said transmission unit providing a second transmission passage and comprising:

means for connecting the transmission unit to said optional cassette module and for enabling said second transmission passage of said transmission unit to be pivotally rotated away from and into alignment with said first transmission passage, and enabling said second passage of second transmission means while aligned with the first transmission means for transmitting said one of the plurality of sheets of paper from only a paper cassette installed in said paper cassette slot through the second transmission means to the first transmission means with outer vertical surfaces of said transmission unit lying substantially flush with adjacent ones of said side walls and said side surfaces while said second passage is aligned with the first transmission means.

4. The optional cassette apparatus of claim 3, further comprising a second paper cassette insertable within said housing, said second paper cassette enclosing an integral third transmission passage aligned between said first transmission passage and said second transmission passage while said second paper cassette is inserted within said housing.

5. An optional cassette module used in an electrophotographic process engine comprising a first transmission passage conducting paper to the process engine and a first housing formed by spaced-apart side walls and a bottom enclosing the process engine and the first passage, said first housing having a first slot enabling a first paper cassette to be received within said first housing, said first transmission passage formed perpendicular to a plane of papers loaded in said first paper cassette, said optional cassette module comprising:

a second housing having a second slot enabling a second paper cassette to be wholly received within said second housing, said second housing occupying space extending from the bottom of the electrophotographic process engine and forming surfaces substantially flush with each of said side walls of the first housing of the electrophotographic process engine;

pick up roller means positioned at a predetermined distance from said second slot and in an upper part of said optional cassette module, for picking up an uppermost paper of the papers loaded in said second paper cassette; and transmission means pivotally connected to said second housing by a hinge located below the first paper cassette and providing a second transmission passage facing and aligned with said first transmission passage, said second transmission passage formed perpendicular to a plane of papers loaded in said second cassette for transmission of paper, said transmission means being positioned adjacent to both the electrophotographic process engine and the optional cassette module and occupying space extending from said bottom of the first housing of the electrophotographic process engine and having outer-most vertical sides lying flush with said surfaces of said second housing and said side walls of the electrophotographic process engine, for transmitting said paper received via said pick up roller means from only the second paper cassette and through said second transmission passage to said first passage to the electrophotographic process engine, said transmission means comprising a transmission roller installed in said second transmission passage, for transmitting the picked-up paper to said electrophotographic process engine.

6. The optional cassette apparatus of claim 5, further a second paper cassette insertable within said first housing, said second paper cassette enclosing an integral third transmission passage aligned between said first transmission passage and said second transmission passage while said second paper cassette is inserted within said second housing.

* * * * *

UNITED STATES PATENT AND TRADEMARK OFFICE

CERTIFICATE OF CORRECTION

PATENT NO. : 5,240,238

DATED : August 31, 1993

INVENTOR(S) : Han-Gyo Lee

It is certified that error appears in the above-indentified patent and that said Letters Patent is hereby corrected as shown below:

On the title page, item [54] and column 1, line 2, before "CASSETTE" insert --OPTIONAL--;

Signed and Sealed this

Thirteenth Day of September, 1994

*Attest:*

Bruce Lehman

BRUCE LEHMAN

*Attesting Officer*

*Commissioner of Patents and Trademarks*